United States Patent [19]

Roberts

[11] Patent Number: 4,527,541

[45] Date of Patent: Jul. 9, 1985

[54] ASSEMBLY FOR INSTALLATION IN CHIMNEY FLUES TO DIRECT STOVEPIPE EXHAUST

[76] Inventor: Charles D. Roberts, 812-A Barstow Ave., Clovis, Calif. 93612

[21] Appl. No.: 603,444

[22] Filed: Apr. 24, 1984

[51] Int. Cl.[3] ..... F24B 7/00

[52] U.S. Cl. ..... 126/123; 126/318

[58] Field of Search ..... 126/82, 858, 94, 120, 126/121, 123, 126, 127, 137, 301, 307 R, 315, 318; 98/58, 60

[56] References Cited

U.S. PATENT DOCUMENTS

| | | | |
|---|---|---|---|
| 1,546,503 | 7/1925 | Meier | 126/126 |
| 1,583,080 | 5/1926 | McCallum | 126/126 |
| 4,026,264 | 5/1977 | Henriques | 126/123 |
| 4,207,862 | 6/1980 | Meyer | 126/137 |
| 4,329,973 | 5/1982 | Scullin | 126/123 |
| 4,422,439 | 12/1983 | Hunt | 126/123 |
| 4,424,794 | 1/1984 | Page | 126/123 |

FOREIGN PATENT DOCUMENTS

| | | | |
|---|---|---|---|
| 875001 | 8/1961 | United Kingdom | 126/120 |

*Primary Examiner*—Margaret A. Focarino
*Attorney, Agent, or Firm*—Worrel & Worrel

[57] ABSTRACT

An assembly for installation in the flue of a fireplace chimney to conduct exhaust from the stovepipe of a fireplace insert or stove directly through the flue, the assembly providing an adjustable mounting subassembly adapted to be attached on the flue; a gasket portion to provide a seal between the edges of the mounting subassembly and the flue surfaces; and a connector portion adapted to be disposed in exhaust flow relation to the stovepipe.

10 Claims, 3 Drawing Figures

ASSEMBLY FOR INSTALLATION IN CHIMNEY FLUES TO DIRECT STOVEPIPE EXHAUST

BACKGROUND OF THE INVENTION

1. Field of the Invention

The present invention relates to an assembly for deployment in the chimney flue of a fireplace or the like to guide exhaust gases and smoke from the stovepipe of a fireplace stove or insert into the chimney, and more particularly to such an assembly which is adjustable for deployment in a wide variety of fireplaces having differing dimensions for use in conjunction with a virtually unlimited variety of fireplace inserts or freestanding stoves.

2. Description of the Prior Art

It has long been recognized that most conventional fireplaces are relatively inefficient in their transmission of radiant heat from wood or other material burned therein into the room or rooms in which such fireplaces are located. It has long been known that a substantial portion of the heat generated by the burning of combustible materials in a conventional fireplace escapes upwardly through the chimney above the fireplace.

Wood-burning stoves and fireplace inserts have gained widespread acceptance and are well known as providing more efficient and economical means for heating interior room spaces using a minimum amount of wood, coal or other fuel, compared to conventional fireplaces.

Conventional fireplace inserts generally provide a firebox or internal burning chamber in which the fuel is burned. The firebox typically has a door or doors on the portion thereof adapted to be disposed in facing relation to the interior of the room to be heated, the doors being used to permit the deposit of fuel in the firebox or the removal of residue therefrom. The insert usually provides an exhaust stovepipe projecting from the predetermined top portion thereof to permit the escape of smoke and other exhaust from the interior of the firebox. In use, the fireplace insert is deployed with all or a substantial portion of the firebox disposed within the fireplace and the stovepipe in substantially axial alignment with the chimney flue for the escape of exhaust upwardly through the chimney.

While conventional fireplace inserts and the like have proven to be effective for their intended purposes, the manner in which exhaust gases are conducted from the interior of the firebox to the chimney presents several drawbacks and dangers. The stovepipes of most conventional fireplace inserts are normally of a substantially lesser external dimension than the internal dimension of the chimney flue of the fireplace in which the insert is disposed. Therefore, cold air in the chimney above the stovepipe outlet opening can flow by the stovepipe downwardly into the fireplace and into the room in which the fireplace is situated, when the damper is open. Further, cold air in the chimney, combined with creosote and soot build-up along the chimney surfaces, can result in the backing up of exhaust gases and smoke discharged from the firebox through the stovepipe whereby such gases and smoke can backwash into the fireplace interior surrounding the firebox and from there into the room. The gases contained in the stovepipe exhaust pose a potential danger in the event they collect about the firebox where, due to exposure to the extreme heat of the firebox exterior, they can ignite explosively. Such explosive combustion has been known to dislodge the fireplace insert from the fireplace and it is obvious an explosion of such a sort presents a very real fire hazard and risk of harm to persons and property. Still further, the smoke and particulate matter contained in the exhaust from the firebox is known to accumulate about the interior of the fireplace to form a layered deposit on the surfaces thereof. Thus, periodic cleaning of the fireplace and flue surfaces, which is a dirty and time-consuming job, is necessary.

Therefore, it has long been known that it would be desirable to have an assembly adapted for use with a wood-burning stove or fireplace insert that would insure that gases and particulate matter, such as smoke, exhausted from the firebox of the insert or stove would be conducted into a communicating chimney without possibility of return to the fireplace in which such stove or insert is disposed. Moreover, it has long been known that it would be desirable to have such an assembly which is adapted for use with myriad different fireplace inserts having stovepipes of varying dimensions and configurations regardless of the chimney flue dimensions of the fireplace in which such fireplace insert or stove is deployed, to interconnect the flue and stovepipe to define a path of flow of exhaust directly from the stovepipe to the chimney.

OBJECTS AND SUMMARY OF THE INVENTION

Therefore, it is an object of the present invention to provide an assembly adapted for installation in fireplace chimney flues and the like to conduct the flow of exhaust from the stovepipe of a fireplace stove or insert deployed in such a fireplace upwardly through the flue.

Another object is to provide such an assembly which is adapted to limit the flow of cold air from the chimney into the fireplace.

Another object is to provide such an assembly which is adapted to obstruct the back-flow of exhaust from the chimney and flue into the fireplace.

Another object is to provide such an assembly which is adjustable for use in a wide variety of fireplace chimney flues having differing dimensions.

Another object is to provide such an assembly which is adapted for use in connection with fireplace inserts having stovepipes of a wide variety of configurations and dimensions.

Another object is to provide such an assembly which is adapted for quick and easy installation and removal.

Another object is to provide such an assembly which substantially minimizes the accumulation of creosote and the like on the interior surfaces of a fireplace in whose chimney it is deployed Another object is to provide such an assembly which is of such exceeding durable construction as virtually to preclude damage thereto over a long operational life.

Another object is to provide such an assembly which is capable of being constructed economically and sold at a nominal price.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figures 1, 2:
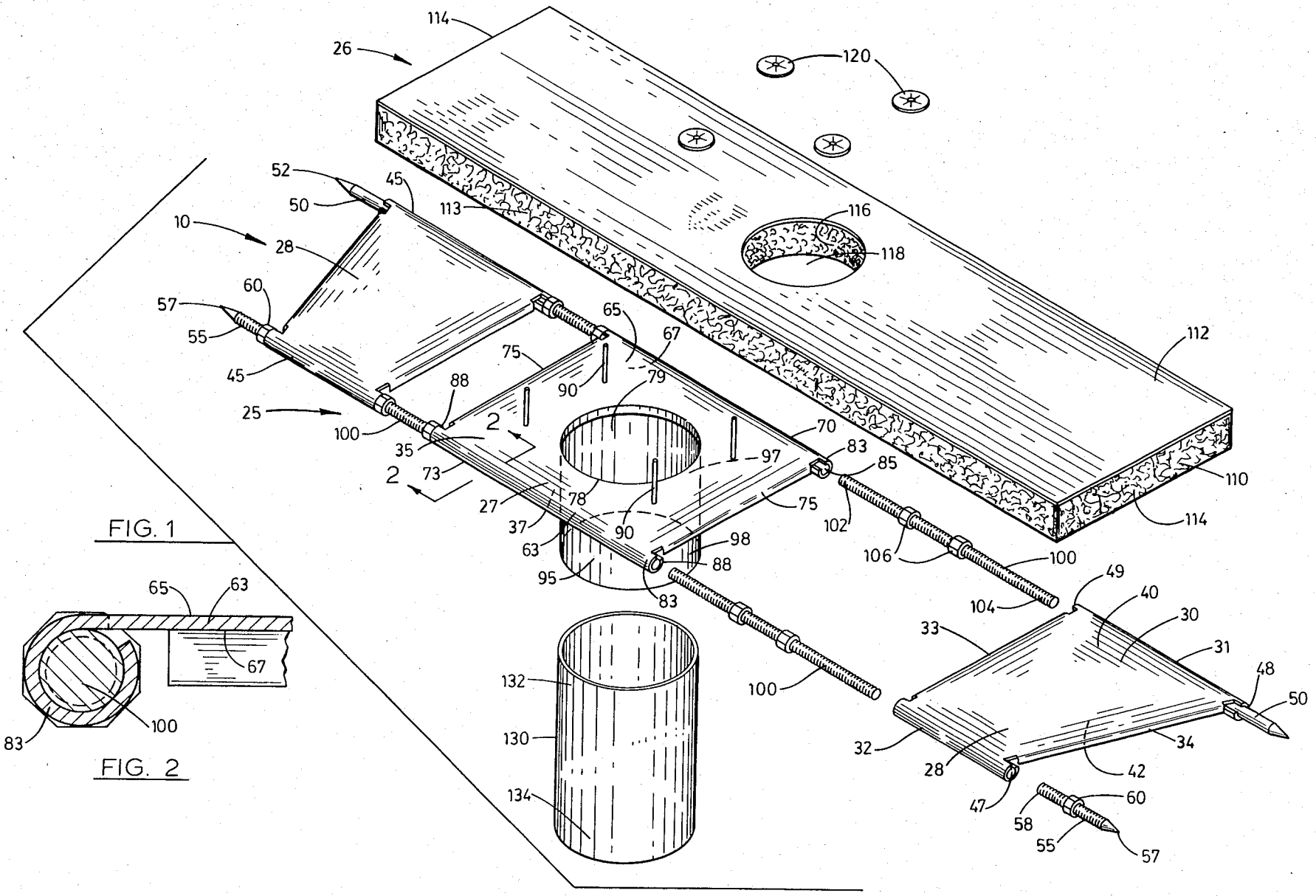
FIG. 1 is a partially exploded perspective view of the assembly of the present invention.
FIG. 2 is a somewhat enlarged transverse section taken on line 2—2 in FIG. 1.
Figure 3:
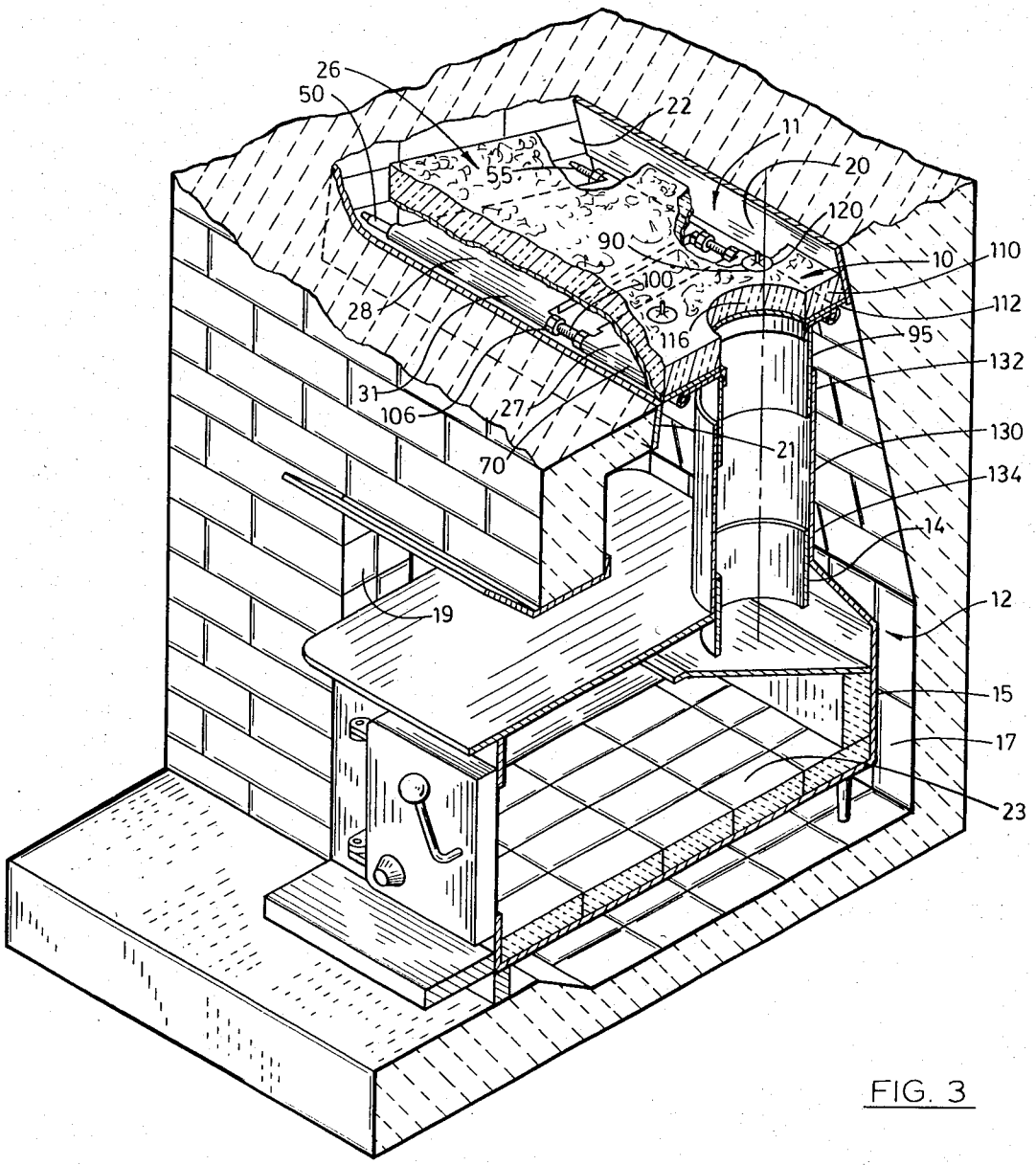
FIG. 3 is a perspective sectional view of the assembly of the present invention deployed in a typical operative environment with portions broken away for illustrative purposes.

The assembly embodying the principles of the present invention is designated generally by the numeral 10 in FIGS. 1 and 3. In FIG. 3, the assembly 10 of the present invention is shown, fragmentarily, installed in a typical operative environment within the flue portion 11 of a chimney (not shown) of a conventional fireplace 12, interconnecting the flue and a stovepipe 14 of a conventional fireplace insert or stove 15.

FIG. 3 is a sectional view taken on the approximate transverse center line of the conventional fireplace 12. As shown therein, the fireplace is typical in its construction of most conventional fireplaces, although it is to be understood that wide varieties in configurations and dimensions are to be expected among conventional fireplaces, and it will be recognized that the assembly 10 of the present invention is adapted for use in conjunction with many such diverse fireplace structures.

The conventional fireplace illustrated in FIG. 3 provides a burning chamber 17 having an external opening 19 communicating with the interior of a room or the like. The chamber 17 converges upwardly into the flue 11 of the chimney. For purposes of definition in this specification, the term "flue" will be understood to refer to the lower portions of a chimney providing a substantially upwardly projecting passage for the escape of exhaust from the chamber of the fireplace and more particularly to those portions of the chimney in substantially close proximity to the chamber 17.

As shown in FIG. 3, the flue 11 provides a predetermined rearward surface 20 and a predetermined forward surface 21 spaced therefrom in facing relation thereto. The rearward surface 20 and forward surface 21 are substantially flat and, as shown in FIG. 3, are disposed obliquely with reference. to each other. It will be recognized that variations in the construction of a given fireplace can and often do result in either the forward surface 21 or rearward surface 20, or both, being disposed in an attitude closer to or farther from vertical than that shown in FIG. 3, and the angle of inclination of such surfaces in FIG. 3 is not to be considered limiting in any respect. Also, as can be seen by reference to FIG. 3, the rearward surface 20 and forward surface 21 are upwardly convergent, which is typical of many conventional fireplaces. However, for purposes of this specification, the term "upwardly convergent" will be understood as referring also to the relative dispositions of a pair of surfaces, one of which is disposed substantially vertically and the other of which is upwardly convergent theretoward.

The flue 11 further provides a pair of lateral, or side surfaces 22, only one of which is illustrated in FIG. 3, interconnecting the rearward surface 20 and forward surface 21. The side surfaces 22, one of which is not shown in FIG. 3, provide substantially flat portions disposed in predetermined facing relation to each other and spaced a predetermined distance from each other. The side surfaces of the flue of FIG. 3 are disposed in a substantially rearwardly convergent attitude, typical of many conventional fireplace flues.

Also depicted in FIG. 3 is a sectional view of a fireplace insert 15 of conventional design and construction having an internal burning chamber 23 and a substantially cylindrical exhaust conduit or stovepipe 14 communicating with the chamber 23 and projecting upwardly therefrom in a substantially axially vertical attitude. It is to be understood that the stovepipe illustrated in FIG. 3 is illustrative of many conventional fireplace insert stovepipes, but it is to be recognized that variations in configurations and dimensions of stovepipes are to be expected and, accordingly, it is to be considered illustrative only and not limiting in any sense. For instance, it is recognized that stovepipes can also be constructed having a substantially rectangular or square cross-sectional configuration. For purposes of this specification, the terms "stovepipe" and "exhaust portion" are to be understood as referring to any conduit adapted to define a path of travel of exhaust from a fireplace insert. Further, the term "fireplace insert" is intended herein to refer to any accessory device adapted for use in conjunction with a conventional fireplace, such as a woodburning stove, or the like, and having a housing adapted for the burning of materials therein and an exhaust portion or stovepipe projecting therefrom for conducting exhaust generated by the burning materials therein upwardly toward a chimney. As can best be seen in FIG. 1, the assembly 10 generally provides an adjustable mounting member or mounting subassembly 25 and a gasket portion 26.

The mounting subassembly 25 has a central portion 27 and a pair of lateral or adjustment members 28 mountable for adjustable movement toward and away from each other on opposite sides of the central portion 27. The adjustment members 28 are substantially similarly configured and dimensioned and therefore like descriptive terminology is equally applicable to each.

Each adjustment member 28 provides a substantially flat body portion 30. The body portion has a substantially straight, first or forward edge 31 and a substantially straight, second or rearward edge 32 spaced from the forward edge and substantially parallel thereto. The forward edge 31 and rearward edge 32 are interconnected by a substantially straight inward edge 33 and a substantially straight outward edge 34 spaced from the inward edge. Preferably, although not necessarily, the inward edge 33 is substantially perpendicular to the forward edge 31 and the rearward edge 32 while the outward edge 34 is substantially obliquely disposed relative to the forward and rearward edges, whereby the forward edge is of a greater length than the rearward edge, as can best be seen by reference to FIG. 1.

The mounting subassembly 25 has a predetermined upper aspect 35 and an opposite, lower aspect 37. The body portion 30 of each adjustment member 28 accordingly provides an upper aspect or upper surface 40 and an opposite, lower aspect or surface 42 subjacent thereto. Each adjustment member 28 provides a pair of tubular or hollow channel members 45 spaced from each other and borne, respectively, subjacently relative to the lower surface 42 along the forward edge 31 and rearward edge 32 to define it. Each channel member has a bore or passage 47 having a longitudinal axis disposed substantially parallel to the edge of the adjustment member which it defines. Thus, the longitudinal axes of the passages 47 are disposed substantially parallel to each other. Preferably, although not necessarily, the channel members are formed unitarily with the body portion 30, although it is to be understood that each channel member 45 can be constructed in the manner of an initially separate tube or the like which is secured on the lower surface or an edge of the body portion, as by welding or the like. The channel members 45 each provide an outward edge 48 and an inward edge 49 spaced longitudinally of each other the length of the channel member.

The channel member 45 disposed along the forward edge 31 mounts a spike or prong member 50 having a pointed tip portion 52 disposed outwardly of the outward edge 34 and having a longitudinal axis concentric with that of the channel member 45 of the forward edge 31. The prong member 50 is of a predetermined length and is secured to the channel member 45 as by welding or the like whereby the prong member is resistent to longitudinal movement thereof. A screw-threaded spike or prong portion 55 of predetermined length having a pointed distal or tip portion 57 an opposite, proximal end portion 58 is provided and is dimensioned for incomplete, slidably removable insertion of the proximal end portion thereof within the passage 47 of the channel member 45 on the rearward edge 32. An adjustment nut 60 is screw-threadably received upon the prong member 55 for screw-threadable movement axially thereof, as is described in greater detail below.

The central portion 27 provides a substantially flat body or frame 63 having an upper surface 65 and an opposite, lower surface 67. The frame is substantially rectangular in configuration and has a substantially straight first or forward edge 70 and a substantially straight, second or rearward edge 73 spaced a predetermined distance therefrom and substantially parallel thereto. Preferably, the forward and rearward edges are spaced a distance substantially equal to that distance by which the forward edge 31 and rearward edge 32 of the body portion 30 of each adjustment member 28 are spaced from each other. The forward edge 70 and rearward edge 73 are interconnected by a pair of substantially straight, lateral edges 75 intersecting normally therewith and disposed substantially parallel to each other.

The frame provides an interior edge 78 which, in the preferred embodiment, is substantially circular in configuration to define a substantially circular aperture 79.

A pair of tubular or channel members 83, each providing 1 a bore or passage 85 longitudinally therethrough, are provided along the rearward edge 73 and forward edge 70, respectively, and define it. The passage 85 of each channel member 83 is substantially tubular in configuration and has a longitudinal axis disposed substantially parallel to the edge along which it is disposed. As with the channel members 45 of the adjustment members 28, the channel members 83 are preferably, although not necessarily, constructed unitarily with the frame 63 of the central portion 27. Each channel member 83 provides a pair of end portions 88 spaced longitudinally of each other the length of the channel members 83.

A plurality of elongated rods or stud members 90 are mounted on the upper surface 65 of the frame 63 uprightly and substantially perpendicular with the frame. In the preferred embodiment, four such stud members are provided, although it is to be understood that the number of stud members can be greater or lesser than four.

A conduit or connecting portion 95 is mounted by the lower surface 67 of the frame 63. The connecting portion provides a predetermined first or upper end portion 97 secured to the frame 63 as by welding or the like and an opposite, lower end portion 98 spaced from the frame. In the preferred embodiment, the connecting portion 95 is of hollow, substantially cylindrical construction having a diameter substantially equal to that of the aperture 79. Further, the upper end portion 97 is of substantially circular, cross-sectional configuration and is substantially concentric with the interior edge 78. However, as will be described in greater detail below, the connecting portion 95 and, more particularly, the lower end portion 98 thereof, can be constructed having other than a cylindrical construction for use in particular operative environments.

The mounting subassembly 12 further provides four elongated, screw-threaded adjustment mounting rods or bolts 100. Each bolt provides a proximal end portion 102 and a distal end portion 104. The proximal end portions 102 are dimensioned for slidable insertion in the passages 85 of the channel members 83 of the frame 63. Similarly, the distal end portions 104 are dimensioned for insertion within the passages 47 of the channel members 45 of the adjustment members 28. Two adjustment nuts 106 are provided for each adjustment bolt 100 and are adapted screw-threadably to be received on the adjustment bolt for screw-threaded movement thereof axially along the bolt between the proximal end portion 102 and the distal end portion 104 thereof.

The gasket portion 26 is of substantially rectangular construction and provides a body 110 mounting a shield or sheet portion 112. The body 110 is constructed of insulating material, such as fiberglass or the like, or of other suitable material having limited flammability. The sheet portion is constructed of aluminum or other suitable substantially flexible material of metal or alloy construction.

The gasket portion 26 provides a pair of substantially straight, longitudinal edge portions 113 spaced from each other a predetermined distance which, in the preferred embodiment, is greater than that distance by which the forward edges 70 and 31 and rearward edges 73 and 32 of the central portion and adjustment members, respectively, are spaced from each other. The gasket portion 26 further provides a pair of endward edge portions 114 spaced from each other the length of the gasket portion. An interior wall or surface 116 of the gasket portion bounds a passage 118 of substantially cylindrical configuration having a diameter substantially equivalent to that of the aperture 79. Preferably, the cylindrical passage 118 is disposed intermediate the endward edge portions 114.

A plurality of washer members 120 are provided having cut-out portions dimensioned slidably to be received upon the stud members 90 and to bias thereagainst substantially to inhibit movement of the washers longitudinally of the stud members away from the frame 63.

Means for interconnecting the connecting portion 95 and the stovepipe 14 in the operative attitude shown in FIG. 3 are provided in the form of a sleeve 130. As can best be seen in FIGS. 1 and 3, the sleeve 130 provides a predetermined upper portion 132 configured to permit slidable reception thereof about the connecting portion 95. The sleeve further has an opposite, lower portion 134 configured to permit close-fitting slidable reception thereof about a portion of the stovepipe 14. It will be recognized that the configuration of the upper and lower portions of the sleeve will be determined by the configurations of the connecting portion 95 and stovepipe 14, respectively, which it is adapted to interconnect. The sleeve is hollow to permit the passage of exhaust from the stovepipe therethrough and to direct the exhaust to the connecting portion.

OPERATION

The operation of the described embodiment of the present invention is believed apparent and is briefly summarized at this point.

The assembly 10 of the present invention is adapted for installation in the flue 11 of the chimney of a fireplace for connection to the stovepipe 14 of a fireplace insert 15 to direct exhaust from the stovepipe into the chimney and to prevent the return of the exhaust to the fireplace 12. Prior to installation of the assembly in the flue 11, the mounting subassembly 25 is first assembled if the component portions thereof are previously disassembled, and, preferably, the fireplace insert is partially or completely removed from the fireplace to afford greater access to the flue for necessary manipulations of the assembly 10 during the installation thereof.

In assembling the mounting subassembly 25, the central portion 27 is grasped manually or rested on a supporting surface to permit access to the passages 85 of the channel members 83. The adjustment nuts 106 are screw-threadably deployed in pairs substantially in proximity to the central portions of the adjustment bolts 100, as can best be seen in FIG. 1. The proximal end portions 102 are then slidably inserted into the passages 85 until the adjustment nut 106 disposed nearest the proximal end 102 is deployed in abutting relation to the end portion 88 of the channel member 83 into whose passage 85 the proximal end 102 has been inserted. Each adjustment member 28 is then individually grasped and manipulated to dispose the channel members 45 in proximity to the distal ends 104 of the adjustment bolts 100. Each adjustment member is then moved toward the central portion 27 whereby the distal end 104 of each adjustment bolt 100 is axially received within the passage 47 of the channel member 45 to which it corresponds. The adjustment member 28 is moved in this fashion until the inward edges 49 of the channel members 45 are in substantially abutting relation to the adjustment nuts 106. If necessary, the adjustment nuts 106 are rotated screw-threadably to be moved toward the inward edges 49 until brought into engagement therewith. When so assembled, the inward edge 33 of the body portion 30 of each adjustment member 28 will be disposed in spaced relation from a lateral edge 75 of the frame 63 of the central portion 27.

The prong portions 55 are then grasped manually and the proximal end portions 58 thereof are, respectively, inserted into the passage 47 of a channel member 45 disposed on the rearward edge portion 32 of each adjustment member 28. The prong portion 55 is moved axially toward the central portion 27 until the adjustment nut 60 abuts the outward edge 48 of the channel member 45. Upon the completion of these steps, the mounting subassembly 25 will be assembled with the frame 63 of the central portion 27 and the body portions 30 of the adjustment members 28 disposed in a substantially common plane. Further, the adjustment bolts 100 mounted forwardly will be disposed substantially coaxially and those bolts 100 mounted rearwardly will similarly be disposed substantially coaxially. Also, the forward edges 31 of the adjustment members 28 and the forward edge 70 of the central portion 27 will be disposed substantially linearly in relation to each other. Similarly, the rearward edges 32 of the adjustment members 28 and the rearward edge 73 of the central portion 27 will also be disposed linearly of each other.

As described previously, the spaced separation of the forward and rearward edges of the central portion 27 and adjustment members 28 is predetermined and substantially identical. In preparing for the installation of the assembly 10 in the flue 11, it is first necessary to determine those points in a substantially horizontal plane at which the rearward surface 20 and forward surface 21 of the flue 11 are separated by a distance slightly greater than the distance between the forward and rearward edges of the components of the assembly. It is helpful in preparing for the installation of the assembly to draw or otherwise mark reference lines along the forward surface 21 and rearward surface 20 to define a substantially horizontal plane in which the mounting subassembly 25 is approximately to be deployed. Such horizontal plane will intersect the side surfaces 22 of the flue 11 along predetermined lines. The distance between the side surfaces 22 where the previously determined line intersects the forwardmost aspects thereof is then measured.

Upon determination of the separation in the predetermined plane of the side surfaces 22, the mounting subassembly 25 is adjusted to dispose the tip portions 52 of the prong members 50 mounted by the channel members 45 of the forward edge 31 a distance from each other slightly less than such determined distance. The adjustment of the mounting subassembly 25 to effect such a spacial separation of the prongs 50 is accomplished by screw-threadably moving the adjustment nuts 106 of the adjustment bolts 100 distally or proximally as needed in reference to the central portion 27. Movement of the nuts distally of the central portion 27 will effect an increase in the overall distance separating the prongs 50. Conversely, screw-threaded movement of the nuts toward the central portion will permit the adjustment members 28 to be manually slid toward each other to reduce the overall separation of the prongs 50. It is preferable that the adjustment nuts disposed nearest the endward edges 49 of the channel members 45 be used for this adjustment to permit the adjustment nuts 106 disposed nearest the central portion to be used for subsequent lateral adjustment of the central portion, as described in greater detail below.

The gasket portion 26 is then deployed to dispose the sheet portion 112 thereof in facing relation to the upper surfaces 40 of the adjustment members 28 and the upper surface 65 of the central portion 27 with the cylindrical passage 118 disposed substantially coaxially with the connecting portion 95. Preferably, the gasket portion 26 has a length greater than the maximum possible separation of the prongs 50. When the gasket portion is deployed to dispose the cylindrical passage 118 coaxially with the connecting portion 95, the endward edge portions 114 thereof will be extended longitudinally beyond the prongs 50. Similarly, as described above, the longitudinal edge portions 113 are spaced from each other a distance greater than the distance separating the forward and rearward edges of the components of the mounting subassembly 25. Accordingly, when operatively deployed, the longitudinal edge portions of the gasket portion will be extended beyond the forward and rearward edges and the adjustment bolts 100. Pressure is exerted on the body 110 of the gasket portion 26 to force the stud members 90 to pierce the sheet portion 112 and penetrate into and through the body 110. The washers 120 are then slid axially along the stud members 90 compressively to engage the body portion 110 to retain the sheet portion 112 of the gasket portion in juxtaposition with the upper surfaces of the components of the mounting subassembly 25.

The assembly 10 is then elevated into proximity with the flue 11 and is disposed in an attitude whereby the lower aspect 37 of the mounting subassembly 25 faces downwardly toward the chamber 17 of the fireplace 12. The prongs 50 are then disposed substantially in the plane determined by the lines previously marked on the rearward surface 20 and forward surface 21 of the flue 11. When elevating the assembly within the flue, the excess portions of the gasket portion will preferably become biased between the periphery of the mounting subassembly and the flue surfaces to effect a substantially airtight seal therebetween. The adjustment nuts 106 abutting the endward edges 49 of the channel members 45 of the adjustment members 28 are then turned screw-threadably to move the tip portions 52 of the prongs 50 into compressive engagement with the side surfaces of the flue in proximity to the forward surface 21. The assembly 10 is then adjusted to dispose the adjustable prongs 55 in substantially the same plane. The adjustment nuts 60 are then screw-threadably rotated to move the tip portion 57 of each prong 55 into compressive engagement with the side surface 22. The assembly 10 is thus securely retained in a substantially horizontal attitude within the flue 11. Further, the gasket portion 26 substantially completely seals all spaces between the surfaces of the flue and the outermost edges of the assembly. Excess portions of the gasket portion subjacent the plane in which the mounting subassembly is disposed can then be trimmed using any appropriate cutting implement to avoid having portions of the gasket portion hang into the fireplace.

The central portion 27 is adapted to be adjusted to deploy the connector portion 95 nearer to one side of the fireplace, as may be required for a particular application. For instance, the stovepipe of most fireplace inserts is disposed substantially centrally between the lateral portions thereof whereby when the insert itself is substantially centered within the fireplace, the stovepipe is disposed in substantially axially direct relation to the chimney. However, space limitations or the particular construction of a given fireplace insert might dictate that the stovepipe be positioned off-center to a certain degree. In the operation of the assembly 10 of the present invention, it is preferable that the connector portion 95 be deployed substantially coaxially with the stovepipe 14 of the fireplace insert 15. Therefore, lateral adjustment of the central portion 27 may become necessary.

To reposition the central portion 27 laterally, or closer to one adjustment member than the other, the adjustment nuts 106 of the adjustment bolts 100 closest to the lateral edge 75 on the lateral portion of the central portion 27 nearest the adjustment members 28 toward which it is desirable to move the central portion are first loosened by screw-threadably turning to move them away from the lateral edge 75 a distance substantially equivalent to that which the central portion 27 must be moved. The central portion 27 is then either grasped manually and slid laterally toward the repositioned adjustment nuts 106 or moved by turning the adjustment nuts abutting the opposite lateral edge 75 whereby the central portion is forced laterally.

The upper portion 132 of the sleeve portion 130 is then slid axially upwardly over the connecting portion 95 toward the lower surface 67 of the frame 63 of the central portion 27 The fireplace insert 15 is then positioned within the fireplace 12 to dispose the stovepipe 14 thereof in coaxial relation with the sleeve 130 and connecting portion 95. The sleeve 130 is then permitted to slide by gravity axially or is moved manually until the lower portion 134 thereof is received about the upright stovepipe.

Thus, the present invention provides an assembly 10 which is adapted directly to connect the stovepipe of a fireplace insert or the like in direct communicating relation with the flue and chimney of a fireplace in which it is deployed. The assembly effectively defines a limited passage through which exhaust can enter the flue. Further, the present invention provides an assembly which operably insures that exhaust emitted from the stovepipe is conducted directly to the chimney with little or no possibility of return thereof to the fireplace, thus minimizing the potential that smoke and noxious fumes can accumulate in the fireplace to form deposits on the surfaces thereof or to be exposed to high temperatures capable of igniting such fumes. Moreover, the assembly of the present invention is adjustably adaptable for use in myriad fireplaces having flues of varying configurations and dimensions for connection to a wide variety of fireplace inserts.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. An assembly for conducting the flow of exhaust from a fireplace insert stovepipe of predetermined dimensions through a chimney flue disposed upwardly thereof and having a predetermined forward surface, a rearward surface spaced from the forward surface, and lateral surfaces spaced from each other and interconnecting the forward and rearward surfaces to define and bound a passage of predetermined dimensions and configuration, the assembly comprising a mounting assembly having a substantially planar portion adapted to be attached on the flue in an operative attitude, the planar portion having predetermined lateral portions individually adapted to be attached on a lateral surface of the flue to support the planar portion in a substantially horizontal attitude and a central portion intermediate the lateral portions laterally adjustable to permit deployment thereof in a selected attitude spaced from the lateral portions, said central portion having a substantially continuous interior edge defining an aperture of predetermined dimensions adapted to permit the flow of exhaust therethrough; a gasket portion dimensioned to be biased by the mounting assembly against the flue surfaces in substantially sealing relation therebetween; and connecting means for connecting the aperture of the mounting assembly and the stovepipe in exhaust flow relation.

2. The assembly of claim 1 wherein the connecting means includes a conduit mounted by the central portion in communication with the aperture and a sleeve member having a first portion dimensioned for attachment on the conduit and a second portion dimensioned for attachment on the stovepipe, the sleeve member having a passage therethrough to define a path of exhaust flow between the stovepipe and the conduit.

3. An assembly for conducting the flow of exhaust from a fireplace insert stovepipe of predetermined dimensions through a chimney flue disposed upwardly thereof and having a predetermined forward surface, a rearward surface spaced from the forward surface, and lateral surfaces spaced from each other and interconnecting the forward and rearward surfaces to define and bound a passage of predetermined dimensions and configuration, the assembly comprising a mounting subassembly adapted for installation in the flue and providing a central portion having an interior edge defining an aperture of predetermined dimensions therethrough, and a pair of adjustment members mounted by the central portion each adjustable for movement thereof toward and away from the central portion, and each having portions adapted to be brought into engagement with a lateral surface of the flue to secure the mounting subassembly in an operative attitude within the flue passage;

a gasket portion adapted to be disposed in supported relation on the mounting subassembly in an operative attitude and having a body dimensioned to occlude a predetermined area of the flue passage in a substantially common plane, the body providing a surface defining a passage therethrough and adapted to be deployed in communicating relation with the aperture of the central portion;

a connecting conduit borne by the central portion and having a passage therethrough disposed in communicating relation with the aperture of the central portion; and means for connecting the connecting conduit in exhaust flow relation to the stovepipe to conduct exhaust from the stovepipe to the aperture.

4. The assembly of claim 3 wherein the central portion of the mounting assembly provides a predetermined forward edge adapted to be disposed in proximity to the forward surface of the flue in an operative attitude and a rearward edge spaced therefrom adapted to be disposed in proximity to the rearward surface of the flue, and the interior edge thereof is disposed in predetermined spaced relation to the forward and rearward edges.

5. The assembly of claim 4 wherein the adjustment members each provide a forward edge adapted to be disposed in proximity to the forward surface of the flue in an operative attitude and a rearward edge spaced from the forward edge and adapted to be disposed in proximity to the rearward surface of the flue.

6. The assembly of claim 5 wherein the adjustment members each provide a predetermined outward edge portion disposed distally of the central portion and each mounts at least one spiked member extended distally of the outward edge thereof and adapted to be brought into engagement with the lateral surface of the flue to secure the mounting subassembly in an operative attitude.

7. The assembly of claim 5 wherein the adjustment members each provide a predetermined outward edge portion disposed distally of the central portion and each provides portions extendin distally therefrom and adapted to secure portions of the gasket portion in sealing relation between the outward edge portions and the lateral surfaces of the flue.

8. The assembly of claim 7 wherein the gasket portion provides edge portions dimensioned to be disposed in biased sealing relation between the forward edges of the central portion and adjustment members and the forward surface of the flue in an operative attitude and further provides edge portions dimensioned to be disposed in biased sealing relation between the rearward edges of the central portion and adjustment members and the rearward surface of the flue in an operative attitude.

9. The assembly of claim 8 wherein the central portion mounts a pair of elongated tubular members each having a longitudinal axis and spaced a predetermined distance from each other in substantially parallel relation; each adjustment member mounts a pair of elongated tubular members each having a longitudinal axis and spaced from each other in substantially parallel relation a distance substantially equal to that by which the tubular members of the central portion are spaced; and the adjustment members are each mounted on the central portion by a pair of elongated bolt members each having a proximal portion slidably axially received within a tubular member of the central portion and a distal portion slidably axially received within a tubular member of the adjustment member.

10. The assembly of claim 9 wherein the bolt members are screw-threaded and each mounts at least two nuts screw-threadably moveable axially thereof selectively to engage the adjustment members and the central portion for movement thereof toward and away from each other.

* * * * *